US007360560B2

(12) United States Patent
Barrett et al.

(10) Patent No.: US 7,360,560 B2
(45) Date of Patent: Apr. 22, 2008

(54) SINGLE LAYER PAPERMAKERS FABRIC

(75) Inventors: Rex Barrett, Neenah, WI (US); Rae Patel, Appleton, WI (US)

(73) Assignee: AstenJohnson, Inc., Charleston, SC (US)

( * ) Notice: Subject to any disclaimer, the term of this patent is extended or adjusted under 35 U.S.C. 154(b) by 0 days.

(21) Appl. No.: 11/343,793

(22) Filed: Jan. 31, 2006

(65) Prior Publication Data

US 2007/0175534 A1 Aug. 2, 2007

(51) Int. Cl.
*D03D 3/04* (2006.01)
*D21F 7/08* (2006.01)
*D03D 25/00* (2006.01)

(52) U.S. Cl. ..... 139/383 A; 139/383 AA; 139/383 R; 162/358.2

(58) Field of Classification Search ..... 139/383 R, 139/383 A, 383 AA; 162/358.2
See application file for complete search history.

(56) References Cited

U.S. PATENT DOCUMENTS 3,301,746 A 1/1967 Sanford et al.
3,573,164 A 3/1971 Friedberg et al.
3,603,354 A 9/1971 Lee et al.
3,905,863 A 9/1975 Ayers
4,142,557 A 3/1979 Kositzke
4,161,195 A 7/1979 Khan
4,182,381 A 1/1980 Gisbourne
4,191,609 A 3/1980 Trokhan
4,239,065 A 12/1980 Trokhan
4,281,688 A 8/1981 Kelly et al.
4,286,631 A * 9/1981 Strandly ..... 139/383 AA
4,290,209 A 9/1981 Buchanan et al.
4,423,755 A 1/1984 Thompson
4,426,795 A 1/1984 Rudt
4,438,788 A 3/1984 Harwood
4,658,863 A * 4/1987 Errecart ..... 139/383 AA
4,815,499 A * 3/1989 Johnson ..... 139/383 A
4,909,284 A 3/1990 Kositzke
4,989,648 A 2/1991 Tate et al.
4,995,428 A 2/1991 Tate et al.
4,998,569 A 3/1991 Tate
5,013,330 A 5/1991 Durkin et al.
5,022,441 A * 6/1991 Tate et al. ..... 139/383 A (Continued)

FOREIGN PATENT DOCUMENTS

EP 0 837 179 4/1998

(Continued)

*Primary Examiner*—Robert Muromoto
(74) *Attorney, Agent, or Firm*—Volpe and Koenig, P.C.

(57) ABSTRACT

A single layer papermakers fabric comprises machine direction (MD) warp yarns interwoven with cross-machine direction (CD) weft yarns to a repeating weave pattern requiring N sheds in the loom, N being an integer and at least 4. Each warp yarn follows a path in the paper side surface comprising four segments in each pattern repeat. In each of the first and third segments, the warp yarn interweaves with three consecutive weft yarns to form a double warp knuckle, and in the second and fourth segments, the warp yarn forms respectively a first and second MD float having unequal float lengths, at least one of the MD floats being over at least N consecutive weft yarns. The fabrics provide high air permeability, and increased surface contact area, stability and seam strength, and are particularly suitable for use as forming fabrics and through air dryer fabrics for tissue and towel products.

16 Claims, 8 Drawing Sheets

U.S. PATENT DOCUMENTS 5,092,373 A * 3/1992 Lee ..... 139/383 AA
5,103,874 A 4/1992 Lee
5,148,838 A * 9/1992 Lee ..... 139/383 AA
5,151,316 A 9/1992 Durkin et al.
5,158,116 A 10/1992 Kazuo et al.
5,211,815 A 5/1993 Ramasubramanian et al.
5,230,371 A * 7/1993 Lee ..... 139/383 A
5,238,027 A * 8/1993 Lee ..... 139/383 AA
5,324,392 A * 6/1994 Tate et al. ..... 162/348
5,366,778 A * 11/1994 Johnson ..... 428/58
5,366,798 A * 11/1994 Ostermayer ..... 442/207
5,411,062 A * 5/1995 Lee ..... 139/383 AA
5,421,375 A * 6/1995 Praetzel ..... 139/383 A
5,456,293 A 10/1995 Ostermayer et al.
5,458,161 A * 10/1995 Scarfe ..... 138/383 AA
5,465,764 A * 11/1995 Eschmann et al. ..... 139/383 A
5,542,455 A 8/1996 Ostermayer et al.
5,544,678 A * 8/1996 Barrett ..... 139/383 A
5,601,120 A * 2/1997 Kuckart et al. ..... 139/383 AA
5,694,980 A * 12/1997 Quigley ..... 138/383 A
5,713,397 A * 2/1998 Quigley ..... 139/383 A
5,713,398 A 2/1998 Josef
5,738,151 A * 4/1998 Lee ..... 139/383 AA
5,787,936 A * 8/1998 Snipes ..... 139/383 AA
5,799,707 A 9/1998 Barrett et al.
5,806,569 A 9/1998 Gulya et al.
RE35,966 E * 11/1998 Lee ..... 139/383 AA
5,857,497 A * 1/1999 Gaisser ..... 139/383 A
6,202,705 B1 * 3/2001 Johnson et al. ..... 139/383 A
6,223,781 B1 * 5/2001 Yamada et al. ..... 139/383 AA
6,227,256 B1 * 5/2001 Quigley ..... 139/383 A
6,240,973 B1 * 6/2001 Stone et al. ..... 139/383 A
6,581,645 B1 * 6/2003 Johnson et al. ..... 139/383 A
6,742,548 B2 * 6/2004 Enqvist ..... 139/383 A
6,810,917 B2 * 11/2004 Stone ..... 139/383 A
6,978,809 B2 * 12/2005 Quigley ..... 139/383 A
7,036,533 B2 * 5/2006 Eckhardt ..... 139/383 A
7,059,359 B2 * 6/2006 Quigley et al. ..... 139/383 A
7,114,529 B2 * 10/2006 Johnson et al. ..... 139/383 A
2006/0003655 A1 1/2006 Patel et al.

FOREIGN PATENT DOCUMENTS

JP 2005-213685 8/2005

* cited by examiner

SINGLE LAYER PAPERMAKERS FABRIC

FIELD OF THE INVENTION

This invention relates to papermaking fabrics and, in particular, to papermaking fabrics comprising a single layer of interwoven warp and weft yarns that are woven according to a weave pattern which provides two unequal warp float lengths for each warp yarn in each repeat of the pattern, each warp float being separated from the next in the machine direction (MD) of the fabric by a double warp knuckle. The novel weave pattern provides for an MD oriented pattern in paper webs which are conveyed in contact with this surface of the fabric, improved seam strength over known prior art single layer designs and high fabric air permeability without undue loss of structural stability. The novel fabrics of this invention are woven according to weave patterns which may be characterized as N×2N or N×4N designs wherein N is the number of sheds in the loom and ranges from 4 to 12 or more. In one embodiment, the use of warp yarns having a generally square or rectangular cross-sectional shape increases fabric contact area with the sheet without need for surface sanding or similar abrasive treatment. In a second embodiment, the warp yarns may be arranged as paired yarns in side-by-side contact so as to further increase surface contact area with the sheet being conveyed. The fabrics of this invention are particularly suitable for through-air drying and tissue forming applications.

BACKGROUND OF THE INVENTION

The selection of appropriate weave patterns for papermaking fabrics is dictated primarily by the intended end use of the textile. For example, forming fabrics, which are used to support and drain the nascent web in the forming section of a papermaking machine, can be constructed as a single layer of interwoven warp and weft yarns, or they may comprise two or more such layers, bound together to form a multilayer or composite fabric; other designs are known and used as appropriate. Fabric constructions including more than one layer of yarns allow the fabric designer to select a weave pattern for the paper side surface which meets the requirements for the sheet, while the machine side layer can be chosen to maximize the ability of the fabric to resist the abrasive and other destructive forces of contact between the fabric and the machine elements. However, there are numerous applications where, for various reasons, a single layer fabric is preferred over a multilayer construction.

Single layer fabrics are particularly appropriate for through-air drying (TAD) of tissue and towel products because the higher operating costs of TAD processes can be offset by a higher production speed and improved sheet quality in terms of bulk, absorbency and softness. The efficiency of the TAD process can be significantly enhanced by the use of single layer fabrics which have a high air permeability. A TAD fabric needs sufficient open area to allow air to pass though once it has passed through the paper web, so as to promote efficient drying. The fabric should also have a sufficiently high contact area on its paper side surface to ensure successful transfer of the sheet from the TAD to subsequent dryer elements, such as a Yankee cylinder. Fabrics intended for this purpose and which impart a machine direction (MD) oriented pattern in the sheet are generally preferred over those which impart a generally cross-machine direction (CD) oriented pattern because this provides the sheet with a smoother feel, which is desirable in consumer oriented products such as tissue, towel and similar absorbent products. An MD oriented pattern in the sheet will require longer MD oriented yarn "floats", or areas in the fabric where the MD oriented yarns are not bound by the CD yarns. Fabric weave patterns which provide long MD oriented floats will generally also provide higher air permeabilities than patterns which do not.

However, the known single layer TAD fabrics have several significant disadvantages which reduce their applicability to certain TAD environments. Firstly, like all single layer fabrics, they present difficulties of ensuring sufficient seam strength to prevent catastrophic seam failure; the interwoven yarns in the seam region are frequently glued in place to prevent their slippage under tension and subsequent fabric failure. Second, single layer fabrics do not possess the mechanical stability of double or multiple layer fabrics and tend to be sleazy and prone to distortion and creasing, which is not desirable. Thirdly, the paper side surfaces of TAD fabrics frequently need to be sanded or otherwise pre-treated so as to render them monoplanar and maximize their contact surface area with the sheet to assure successful sheet transfer from the TAD section, as noted above.

DISCUSSION OF PRIOR ART

TAD fabrics and other papermaking fabrics which are intended to impart a pattern to the paper web formed thereon are well known. See, for example, U.S. Pat. No. 3,301,746 to Sanford et al., U.S. Pat. No. 3,603,354 to Lee, U.S. Pat. No. 3,905,863 to Ayers, U.S. Pat. No. 4,182,381 to Gisbourne, U.S. Pat. No. 4,191,609 and U.S. Pat. No. 4,239,065 both to Trokhan, U.S. Pat. No. 4,281,688 to Kelly et al., U.S. Pat. No. 4,423,755 to Thompson, U.S. Pat. No. 4,909,284 to Kositzke, U.S. Pat. No. 4,989,648, U.S. Pat. No. 4,995,428 and U.S. Pat. No. 4,998,569 all to Tate et al., U.S. Pat. No. 5,013,330 and U.S. Pat. No. 5,151,316 to Durkin et al., U.S. Pat. No. 5,158,116 to Tate et al., U.S. Pat. No. 5,211,815 to Ramasubramanian et al., U.S. Pat. No. 5,456,293 and U.S. Pat. No. 5,542,455 both to Ostermayer et al. Others are known.

It is also known to provide longer floats in the cross-machine direction (CD) on the machine side surface of a single layer fabric, to increase the wear resistance of that surface, for example in U.S. Pat. No. 4,161,195 to Khan. It is also known to provide longer CD floats in the machine side surface by the use of two sets of CD yarns of different sizes, together with the provision of longer machine direction (MD) floats in the paper side surface, for example in U.S. Pat. No. 5,806,569 to Gulya et al., for a forming fabric with a non-planar surface. Further, Ichihiro in JP 2005-213685 discloses weave patterns having longer CD floats in the paper side surface, over four MD yarns, to provide non-uniformity to the sheet.

It is known from U.S. Pat. No. 4,142,557 to Kositzke, U.S. Pat. No. 4,290,209 to Buchanan et al., U.S. Pat. No. 4,438,788 to Harwood, U.S. Pat. No. 4,815,499 to Johnson, and U.S. Pat. No. 5,103,874 to Lee, amongst others, to use rectangular, square or generally flattened yarns in the manufacture of papermaking fabrics. It is also known, for example, from U.S. Pat. No. 5,713,398 and EP 837 179, both to Josef, to use pairs of warp yarns weaving as one in the manufacture of papermaking fabrics. From U.S. Pat. No. 3,573,164 to Friedberg et al., and U.S. Pat. No. 4,426,795 to Rudt, it is known to increase fabric surface contact area with the sheet by abrading the weave knuckles of the interwoven yarns. More recently, U.S. 2006/0003655 to Patel et al. discloses a single layer TAD fabric woven using flat warp and/or weft yarns to provide a fabric having between 20% to 30% contact area with the paper sheet without need to sand or otherwise abrade the fabric surface.

It is also known from U.S. Pat. No. 5,544,678 to Barrett to use an N×2N weave design, wherein N is the number of sheds in the loom, to provide an advantageous pattern to meet the end use requirements for the machine side layer of a composite forming fabric. For the fabrics of that invention, there are two separate fabric layers (a paper side layer and a machine side layer) which are woven to differing weave patterns and connected together by means of binder yarns. The machine side layer can be woven according to a variety of N×2N designs to overcome problems of warp yarn twinning, lateral tracking of the fabric in operation, sheet marking and seam strength. There is no teaching of the use of the disclosed N×2N patterns in a single layer structure without a separate paper side layer to provide the desired paper side surface properties, and attached to the machine side layer by means of binder yarns.

It has now been found that certain N×2N, N×4N and other related weave patterns can be used for the design of a single layer fabric, to provide long MD floats in one surface of the fabric which is preferably in contact with the paper sheet when in operation, in which the floats for each MD yarn are unequal in length, at least one of the floats being over at least four CD yarns, and the two unequal floats for each MD yarn are separated by a double warp knuckle in which the yarn interweaves with a group of three consecutive CD yarns. The two different MD float lengths provide for bulk enhancement of the paper sheet and the warp yarns are interwoven with selected weft yarns such that the resulting fabric provides significantly reduced lateral drift and improved lateral tracking of the fabric when in use on the papermaking machine as compared to similar prior art fabrics. The long MD floats also provide an increase in contact area over plain weave designs, which is desirable to provide increased support to the paper web, particularly in a TAD process. The weave patterns further provide for relatively long CD oriented weft yarn floats on the machine side surface of the fabric so as to increase service life. Further, by providing a high profile to the paper side surface, the fabrics of the invention are particularly suitable for use either as forming fabrics for tissue and related products, or as dryer fabrics in a TAD process.

In addition, the double warp knuckle segments which, on adjacent MD yarns are preferably displaced by at least one CD yarn, offer improved stability for the fabrics of the invention, and in particular provide enhanced seam strength to prevent the catastrophic seam failure which is known to occur in prior art single layer fabrics.

It has further been found that by the use of paired warp yarns, which in the area of the woven seam will terminate at different locations, an additional advantageous increase in seam strength can be achieved, substantially reducing or avoiding the necessity for gluing the ends of the warp yarns as is generally required for known single layer fabrics.

Still further, it has been found that the use of square or generally rectangular profile warp yarns can provide an advantageous increase in the fabric contact area, without the necessity of sanding or other surface treatment of the fabric, which is particularly useful for TAD applications, and further provides extra strength in the seam area, compared with known TAD fabrics.

SUMMARY OF THE INVENTION

The invention therefore seeks to provide a single layer papermakers fabric having a paper side surface and a machine side surface and comprising machine direction (MD) warp yarns interwoven with cross-machine direction (CD) weft yarns to a repeating weave pattern requiring N sheds in the loom, wherein N is an integer and is at least 4, and wherein the warp yarns follow paths in the paper side surface comprising in each repeat for each warp yarn a first, second, third and fourth segment, wherein:

(i) in each of the first and third segments, the warp yarn interweaves with a first and second group of weft yarns each group comprising three consecutive weft yarns at respective first and second interweaving locations to form a double warp knuckle; and (ii) in the second and fourth segments, the warp yarn forms respectively a first and second MD float of unequal float lengths wherein at least one of the MD floats is over at least N consecutive weft yarns.

Preferably, the repeating weave pattern is selected from an N×2N pattern and an N×4N pattern, and N is selected from 4, 5, 6, 8, 10, 12, 16, 20 and 24.

Preferably, for each warp yarn the interweaving locations are offset from interweaving locations on each adjacent warp yarn at displacement zones each comprising at least one weft yarn.

Optionally, for each warp yarn, each of the first and second MD floats can be over at least N consecutive weft yarns.

Optionally, all of the warp yarns can be woven as pairs in which each member of a pair interweaves with the same weft yarns as the other member of that pair.

Preferably, the warp yarns have a cross-sectional profile in the CD selected from substantially circular, substantially elliptical, substantially rectangular and substantially square, and where the warp yarns comprise pairs, preferably the cross-sectional profile is substantially square.

Preferably, the weft yarns have a weft cross-sectional area which is at least equal to a warp cross-sectional area of the warp yarns, more preferably the weft cross-sectional area exceeds the warp cross-sectional area by a range between 0% and 15%, and most preferably by a range between 10% and 15%.

Preferably, the fabric has an air permeability in a range of 450 to 1,200 cubic feet per minute, and a mesh in a range of 20 to 70 yarns per inch.

Preferably, the fabric is a through air dryer fabric or a forming fabric.

The term "knuckle" as used herein refers to a location in a fabric where a first yarn, such as a warp yarn, is interwoven with and thereby bent around a second yarn, such as a weft yarn, that is oriented approximately orthogonally to the first yarn. Due to the sharp bend, or crimp, formed by the first yarn as it passes around the second yarn, a "knuckle" is created at the bending point which generally tends to stand proud of the fabric surface. The related term "double warp knuckle" is used to describe the path of a warp yarn in interweaving with three consecutive yarns by passing under one weft yarn, over the next weft yarn and under the next weft yarn (i.e. under 1, over 1, under 1, to form a plain weave portion within the overall pattern repeat). In the fabrics of the invention, each warp yarn forms two double knuckles within each repeat of the overall fabric weave pattern.

The related term "float" refers to a locus where a first yarn passes over (or under) a plurality of second yarns without interweaving with them; the associated term "float length" refers to the number of second yarns that are passed over (or under) by the first.

DETAILED DESCRIPTION OF THE DRAWINGS

Figure 1:
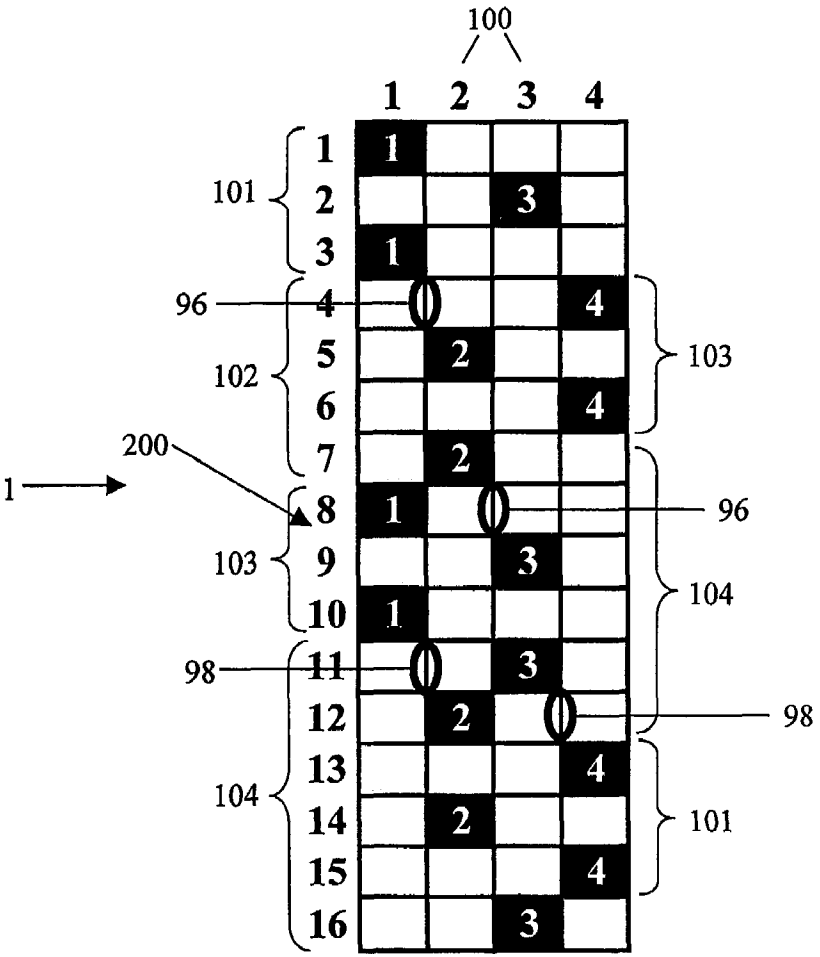
FIG. 1 is a weave diagram of a first embodiment of a fabric of the invention.

Referring first to FIG. 1, a weave diagram of a first broad embodiment of the invention is shown. Fabric 1 comprises warp yarns 100, shown numbered across the top of the figure as yarns 1 to 4, which are interwoven with weft yarns 200, numbered down the left side of the figure as yarns 1 to 16. In this figure, and also in each of FIGS. 2 to 6, the dark squares indicate points at which a warp yarn 100 interweaves with (by passing beneath, or on the machine side of) a weft yarn 200, and the blank squares indicate points at which a warp yarn 100 floats over the weft yarns 200, on the paper side surface. This fabric is woven to an N×4N pattern, in which N represents the number of sheds in the loom and, in this embodiment, N is 4, i.e. one repeat of the pattern comprises four warp yarns interweaving with 16 weft yarns. As this is a single layer fabric, the diagram is also schematically representative of what would be seen from the paper side surface 10 (shown more clearly in FIG. 7) of the fabric 1.

It can be seen that the path of each warp yarn 100 is identical, although the interweaving points of each consecutive warp yarn 100 are displaced from those of the preceding warp yarn 100. Thus for warp yarn 1 in FIG. 1, in a first segment 101 the warp yarn interweaves with weft yarns 1 and 3, to form a double knuckle.

In a second segment 102, warp yarn 1 floats over four weft yarns 200 (i.e. weft yarns 4 to 7), before a third segment 103 in which warp yarn 1 interweaves with weft yarns 8 and 10 to form a second double knuckle, and a fourth segment 104 in which warp yarn 1 floats over six weft yarns 200 (weft yarns 11 to 16). For each of warp yarns 2, 3 and 4 the paths are identical; in their respective first segments 101, warp yarn 2 interweaves with weft yarns 5 and 7; warp yarn 3 interweaves with weft yarns 9 and 11, and warp yarn 4 interweaves with weft yarns 13 and 15. The double knuckles on adjacent warp yarns of the fabrics of the invention are separated from each other by displacement zones, seen in FIG. 1 as first and second displacement zones 96, 98, each comprising one weft yarn. Thus, after the last interweave of warp yarn 1 in its first segment 101, at weft yarn 3, first displacement zone 96 comprises weft yarn 4, before the first interweave of warp yarn 2 in its first segment 101 at weft yarn 5. Similarly, after the last interweave of warp yarn 1 in its third segment 103, there is a one weft yarn second displacement zone 98, comprising weft yarn 11, before the first interweave of warp yarn 2 in its third segment at weft yarn 12.

Figure 2:
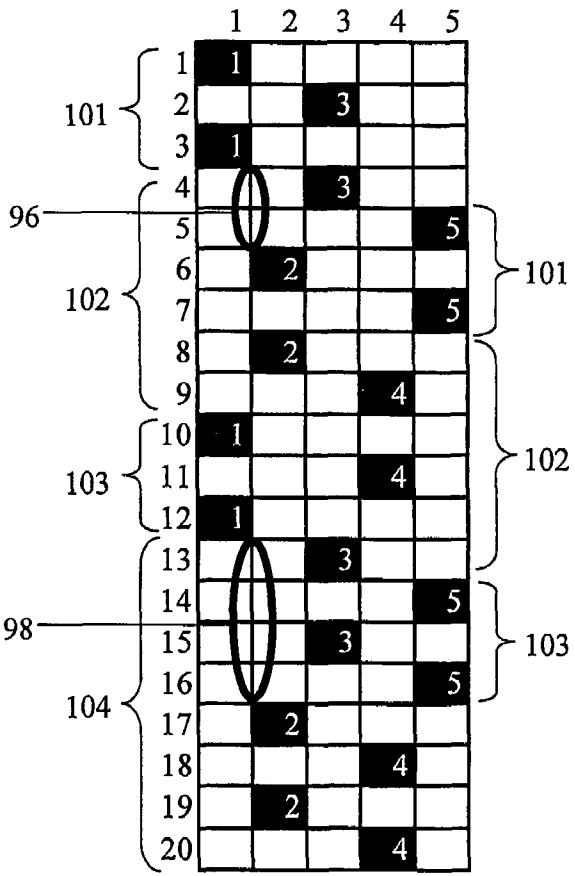
FIGS. 2 and 3 are weave diagrams of variants of the embodiment of FIG. 1.

Referring now to FIG. 2, a variant of the first embodiment is shown. This weave diagram also shows an N×4N pattern, in which N is 5, the warp yarns 100 being numbered across the top of the figure as warp yarns 1 to 5, and the weft yarns 200 being numbered at the left side of the figure as weft yarns 1 to 20. Each warp yarn 100 follows a similar path to that of the warp yarns of FIG. 1, but the floats for the second and fourth segments 102, 104 are respectively over six and eight weft yarns. In this embodiment, the first and second displacement zones 96 and 98 are unequal, comprising respectively two and four weft yarns 200. For example, after the last interweave of warp yarn 1 in its first segment 101, at weft yarn 3, first displacement zone 96 comprises weft yarns 4 and 5; whereas after the last interweave of warp yarn 1 in its third segment 103, at weft yarn 12, second displacement zone 98 comprises weft yarns 13, 14, 15 and 16. As in the embodiment shown in FIG. 1, for each warp yarn 100, the long paper side float in the second segment is not the same length as the long paper side float in the fourth segment.

Figure 9:
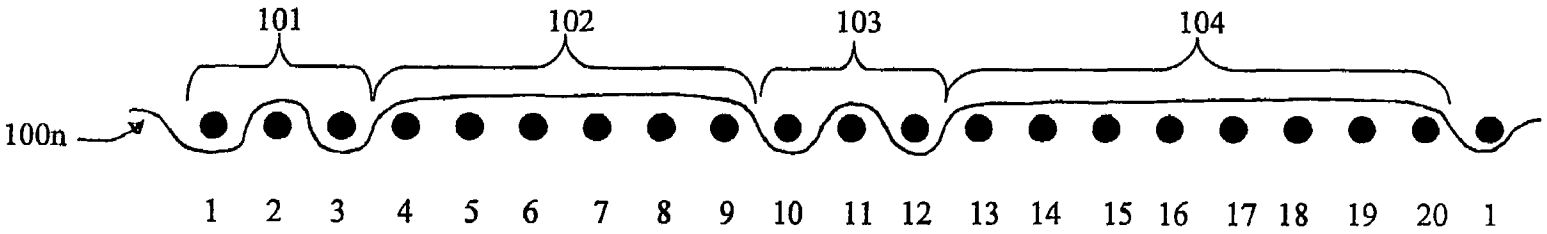
FIG. 9 shows the warp profile of a warp yarn of the fabrics of FIGS. 2, 7 and 8.

The path of each warp yarn 100 in the embodiment of FIG. 2 can be seen in FIG. 9, which shows the path in a cross-section of the fabric 1 along the MD. Thus, considering the paper side surface 10 as the upper side of the fabric 1 and the machine side surface 12 as the lower side, warp yarn 100*n* in its first segment 101 passes under weft yarn 1, over weft yarn 2, under weft yarn 3, to form a first double knuckle. In its second segment 102, warp yarn 110*n* floats over weft yarns 4 to 9. In its third segment 103, warp yarn 100*n* passes under weft yarn 10, over weft yarn 11, under weft yarn 12, to form a second double knuckle; and in its fourth segment 104 it floats over weft yarns 13 to 20, before commencing its next first segment 101 with weft yarn 1 of the next repeat.

Figure 10:
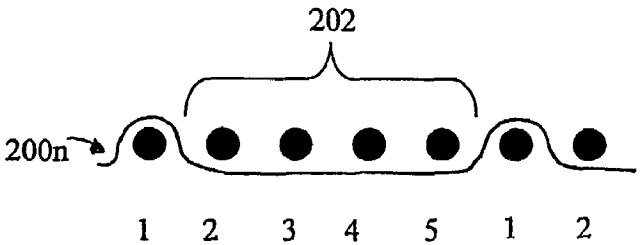
FIG. 10 shows the weft profile of a weft yarn of the fabric of FIGS. 2, 7 and 8.

Referring now to FIG. 10, the path of each weft yarn 200 of the embodiment of FIG. 2 can be seen. Thus weft yarn 200*n* passes over warp yarn 1, floats under warp yarns 2 to 5, and passes over warp yarn 1 in the next repeat. This weft float assists in protecting the warp yarns 2 to 5 from the abrasive wear due to contact with the various stationary wear surfaces of the papermaking machine, and contributes to extending the wear life of the fabric.

Figure 11:
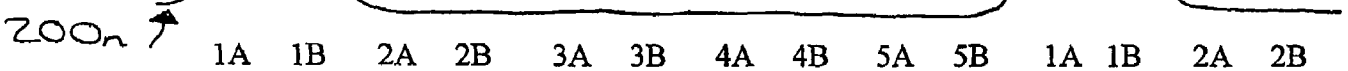
FIG. 11 shows the weft profile of a weft yarn of the fabric of FIG. 6.

Referring to FIGS. 10 and 11 together, it can be readily seen that in the paper side surface 10 of the fabric 1, all the warp yarns 100 have long MD floats in their second and fourth segments 102 and 104 respectively, whereas in the machine side surface 12 of the fabric 1, all the weft yarns 200 have long CD floats 202, having a float length of 4.

Figure 3:
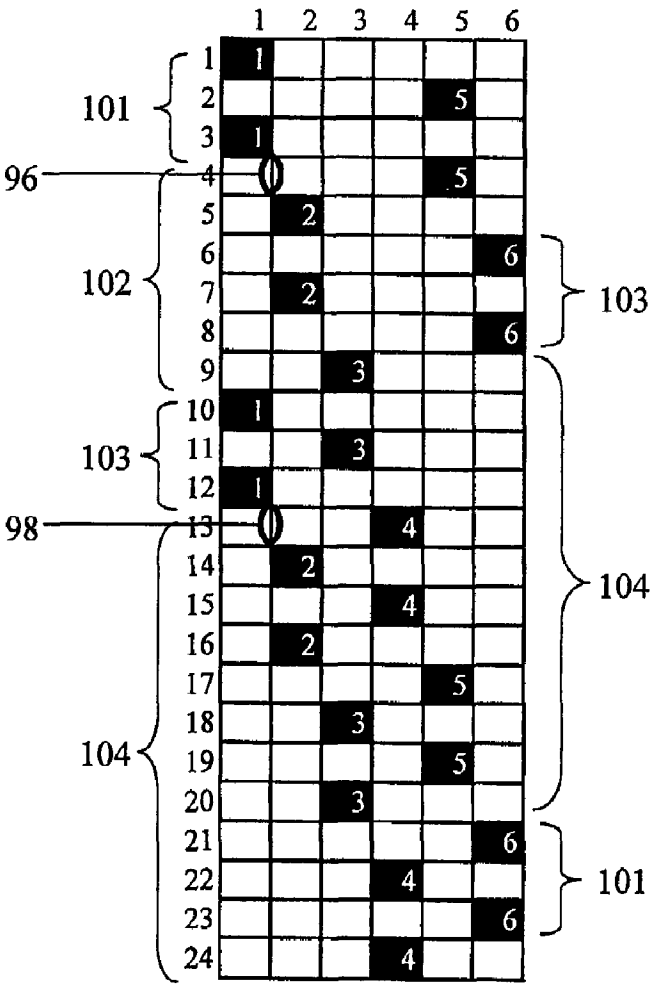

Referring to FIG. 3, a further variant of the first embodiment is shown, comprising an N×4N pattern in which N is 6, the warp yarns 100 being numbered across the top of the figure as warp yarns 1 to 6, and the weft yarns 200 being numbered at the left side of the figure as weft yarns 1 to 24. The float length of each second segment 102 is six, and the float length of each fourth segment 104 is twelve, and the first and second displacement zones 96, 98 are equal, each comprising one weft yarn 200.

Figure 4:
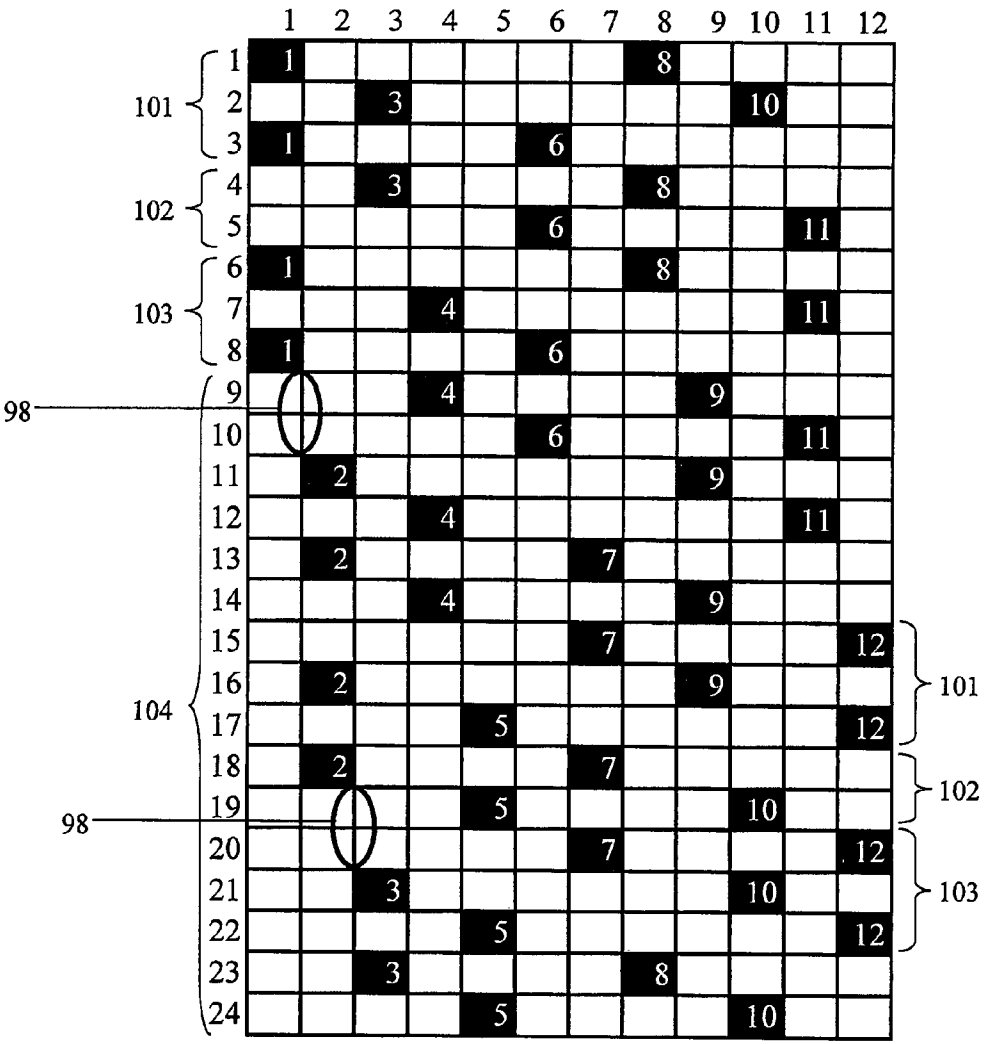
FIG. 4 is a weave diagram of a second embodiment of a fabric of the invention.

FIG. 4 shows a second broad embodiment of the invention, comprising an N×2N weave pattern in which N is 12, the warp yarns 100 being numbered across the top of the figure as warp yarns 1 to 12, and the weft yarns 200 being numbered at the left side of the figure as weft yarns 1 to 24. It can be seen that the second and fourth segments 102 and 104 are again unequal, the float length of each second segment 102 being two and that of each fourth segment 104 being sixteen. It can also be seen that the first and third segments 101, 103 on each warp yarn are separated by two weft yarns (for example weft yarns 4 and 5 in relation to warp yarn 1), so that there is no first displacement zone 96 in this pattern. However, each displacement zone 98 comprises two weft yarns 200. For example, in relation to warp yarn 1, after the last interweave of the third segment 103 at weft yarn 8, displacement zone 98 comprises weft yarns 9 and 10, and in relation to warp yarn 2, displacement zone 98 comprises weft yarns 19 and 20.

Figure 5:
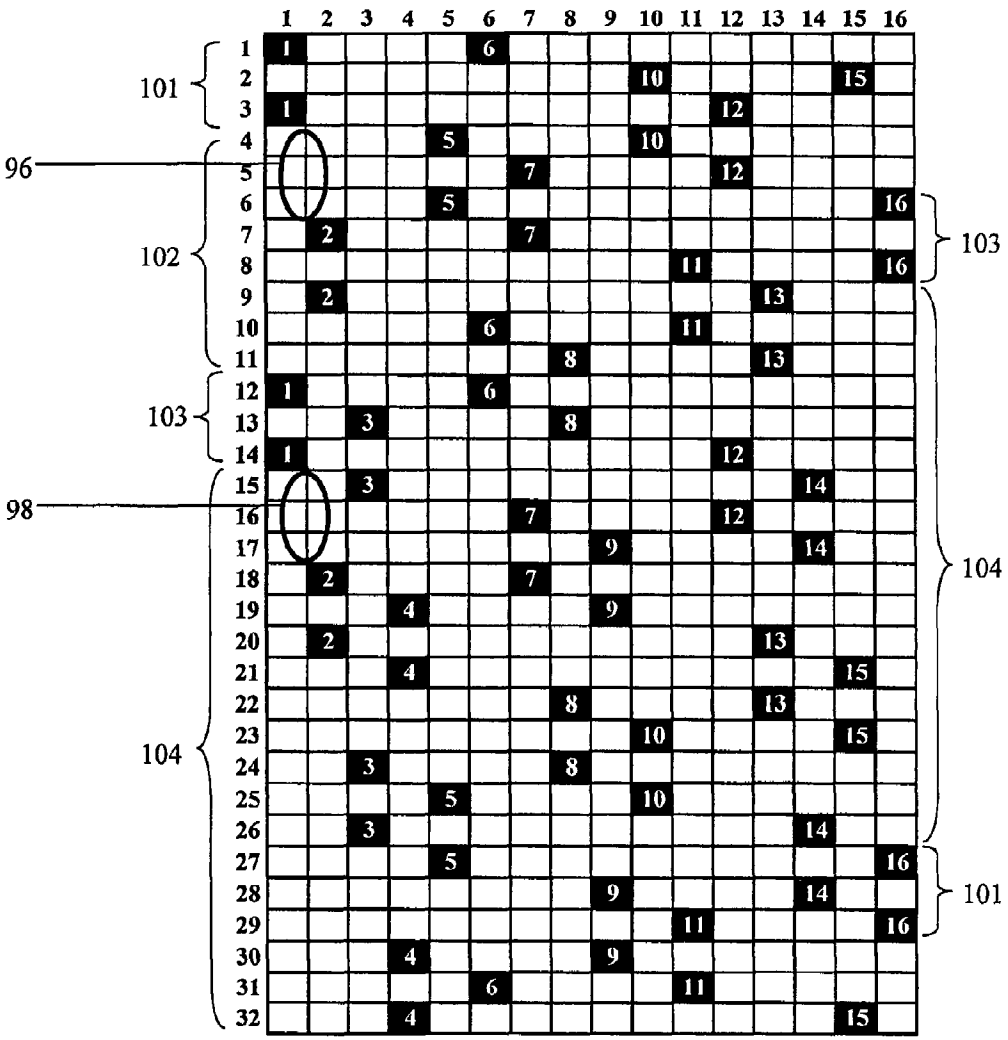
FIG. 5 is a weave diagram of a variant of the embodiment of FIG. 5.

FIG. 5 shows a variant of the second broad embodiment of the invention, comprising an N×2N weave pattern in which N is 16, the warp yarns 100 being numbered across the top of the figure as warp yarns 1 to 16, and the weft yarns 200 being numbered at the left side of the figure as weft yarns 1 to 32. As in the previously illustrated embodiments, the first and third segments 101, 103 include double warp knuckles as at weft yarns 1 to 3 and 12 to 14 on warp yarn 1. The second segments 102, comprising floats over eight weft yarns 200, are unequal to the fourth segments 104, which comprise floats over eighteen weft yarns 200. Each of first and second displacement zones 96, 98 comprises three weft yarns 200.

In each of the weave patterns of FIGS. 1, 2 and 3, in each repeat each of the weft yarns 200 has two floats in the machine side surface 12 which are of equal float length, whereas in the weave patterns of FIGS. 4 and 5, in each repeat each of the weft yarns 200 has two long CD floats of unequal float length in the machine side surface.

Figure 6:
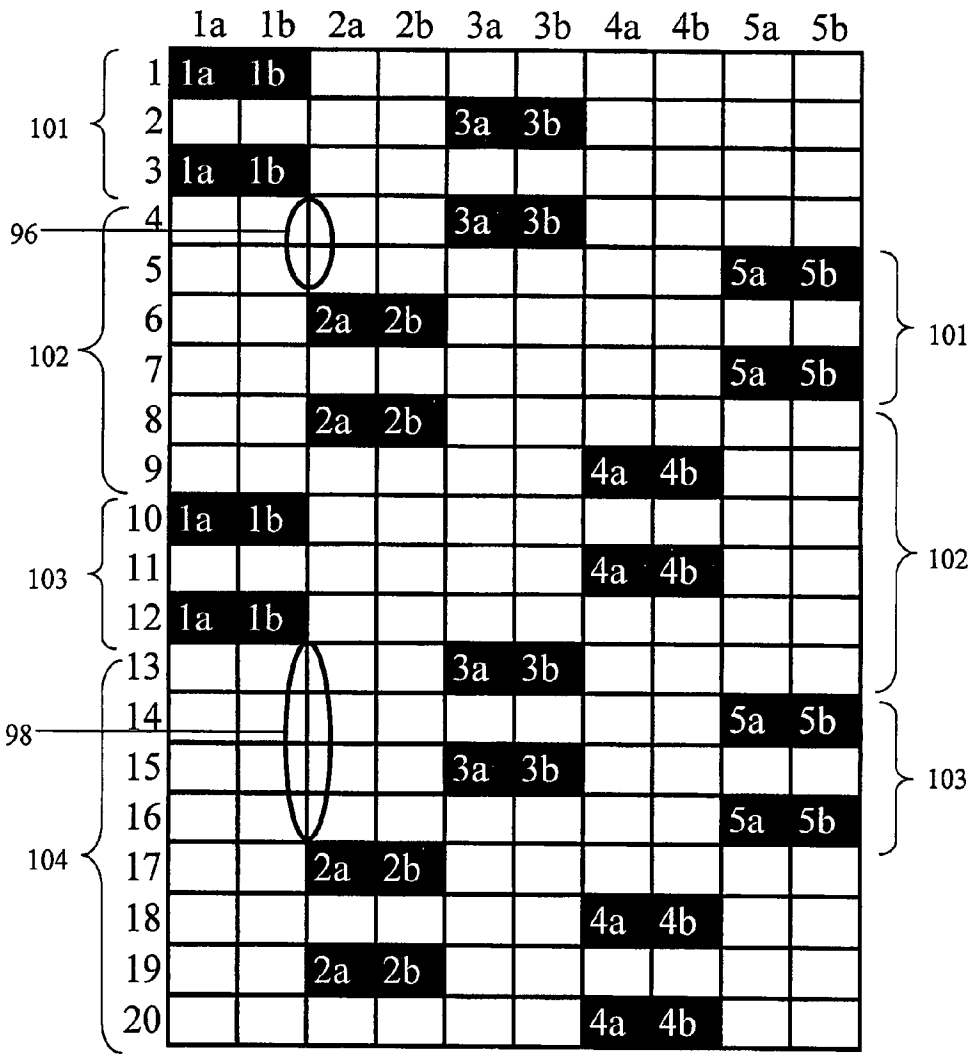
FIG. 6 is a weave diagram of a third embodiment of a fabric of the invention.

Referring to FIG. 6, a third embodiment of the invention is shown. This comprises an N×2N pattern, in which N is 10, the ten warp yarns 100 being numbered across the top of the figure as warp yarns 1*a* to 5*b*, and the weft yarns 200 being numbered at the left side of the figure as weft yarns 1 to 20. However, the ten warp yarns 100 comprise five pairs, and in each pair the two members, identified as "a" and "b" yarns, follow an identical undisplaced path to each other. For example, for warp yarn 1*a* and 1*b* the first segment 101 comprises interweaving with weft yarns 1 and 3, the second segment 102 is a paper side float over six weft yarns 200 (i.e. weft yarns 4 to 9), the third segment 103 comprises interweaving with weft yarns 10 and 12, and the fourth segment 104 is a paper side float over eight weft yarns 200 (i.e. weft yarns 13 to 20). It can also be seen that first and second displacement zones 96 and 98, between each "b" yarn of each pair and the adjacent "a" yarn of the next pair, comprise respectively two and four weft yarns 200.

Referring now to FIG. 11, the path of each weft yarn 200 of the embodiment of FIG. 6 can be seen. Thus weft yarn 1 passes over warp yarns 1*a* and 1*b*, floats under warp yarns 2*a*, 2*b*, 3*a*, 3*b*, 4*a*, 4*b*, 5*a*, 5*b*, and passes over warp yarns 1*a* and 1*b* in the next repeat. In this embodiment, the warp yarns 100 are shown as having a substantially rectangular cross-section, which has been found to be advantageous in weave patterns for fabrics of the invention in which paired warp yarns 100 are used.

Figure 7:
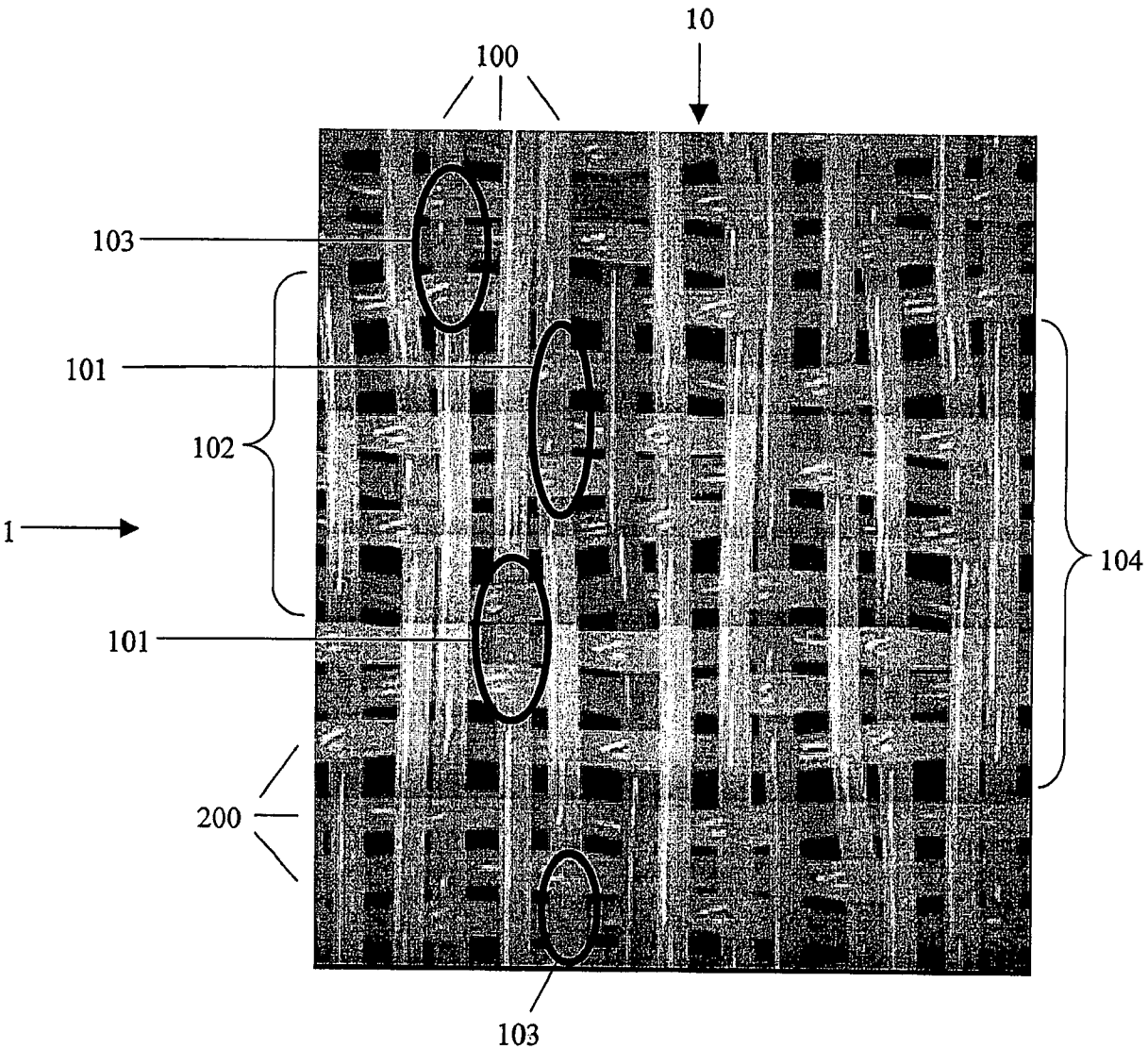
FIG. 7 is a photograph of the paper side surface of a fabric woven according to the pattern shown in FIG. 2.

FIG. 7 is a photograph showing the paper side surface 10 of a fabric 1 of the invention, in this case woven to the pattern of FIG. 2. The long paper side MD floats of the warp yarns 100, having unequal float lengths in the second segments 102 and the fourth segments 104 can be seen, as can the displacement in relation to the first segments 101 and to the third segments 103 of consecutive warp yarns 100.

Figure 8:
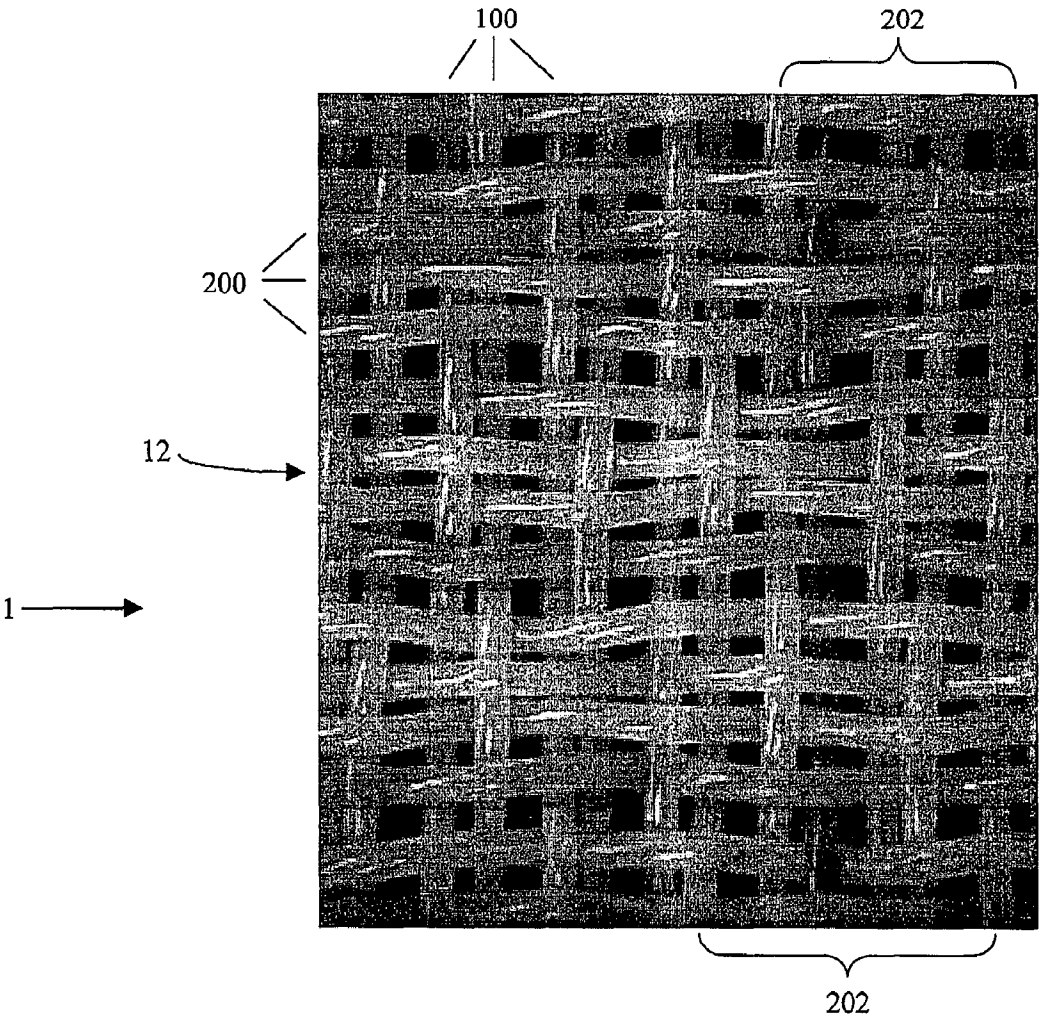
FIG. 8 is a photograph of the machine side surface of a fabric woven according to the pattern shown in FIG. 2.

FIG. 8 is a photograph showing the machine side surface of the fabric in FIG. 7 which is woven according to the pattern shown in FIG. 2. The long CD floats 202 of the weft yarns 200 can be clearly seen.

The materials and sizes of the warp and weft yarns for the fabrics of the invention can be suitably selected according to the intended end use of the fabric. For example, where the fabric is intended for use in a TAD process, the yarns are required to have heat stability, and hydrolysis resistance; and the weft yarns 200 should have a cross-sectional area which is at least equal to that of the warp yarns 100. Preferably, the cross-sectional area of the weft yarns 200 should exceed that of the warp yarns 100 by between 0% and 15%, most preferably between 10% and 15%.

The mesh range for the fabrics of the invention, again depending on the intended end use, will preferably be in the range of 20-70 yarns/inch (7.87-27.6 yarns/cm). It has been found that air the fabrics of the invention have an permeability of between 450 and 1,200 cubic feet/minute, and a seam strength of up to 150 pounds/linear inch.

It has further been found that the use of substantially rectangular yarns for the warp yarns 100 in the fabrics of the invention can provide a sheet contact area of up to 20% to 25% or more, without surface sanding or abrading, which is particularly advantageous for TAD fabrics.

We claim:

1. A single layer papermakers fabric having a paper side surface and a machine side surface and comprising machine direction (MD) warp yarns interwoven with cross-machine direction (CD) weft yarns to a repeating weave pattern requiring N sheds in the loom, wherein N is an integer and is at least 4, and wherein the warp yarns follow paths in the paper side surface comprising in each repeat for each warp yarn a first, second, third and fourth segment, wherein (i) in each of the first and third segments, the warp yarn interweaves with a first and second group of weft yarns each comprising three consecutive weft yarns at respective first and second interweaving locations to form a double warp knuckle; and (ii) in the second and fourth segments, the warp yarn forms respectively a first and second MD float having unequal float lengths wherein at least one of the MD floats is over at least N consecutive weft yarns.

2. A single layer papermakers fabric as claimed in claim 1 wherein the repeating weave pattern is selected from an N×2N pattern and an N×4N pattern.

3. A single layer papermakers fabric as claimed in claim 1 wherein for each warp yarn each of the first and second MD floats is over at least N consecutive weft yarns.

4. A single layer papermakers fabric as claimed in claim 1 wherein N is selected from 4, 5, 6, 8, 10, 12, 16, 20 and 24.

5. A single layer papermakers fabric as claimed in claim 1 wherein for each warp yarn the interweaving locations are offset from interweaving locations on each adjacent warp yarn at displacement zones each comprising at least one weft yarn.

6. A single layer papermakers fabric as claimed in claim 1 wherein all of the warp yarns comprise pairs in which each member of a pair interweaves with the same weft yarns as the other member of that pair.

7. A single layer papermakers fabric as claimed in claim 6 wherein for each warp yarn pair the interweaving locations are offset from interweaving locations on the warp yarns of each adjacent warp yarn pair by at least one weft yarn.

8. A single layer papermakers fabric as claimed in claim 1 wherein the warp yarns have a cross-sectional profile in the CD selected from substantially circular, substantially elliptical, substantially rectangular and substantially square.

9. A single layer papermakers fabric as claimed in claim 8 wherein the cross-sectional profile is substantially square.

10. A single layer papermakers fabric as claimed in claim 8 wherein the weft yarns have a weft cross-sectional area which is at least equal to a warp cross-sectional area of the warp yarns.

11. A single layer papermakers fabric as claimed in claim 10 wherein the weft cross-sectional area exceeds the warp cross-sectional area by a range between 0% and 15%.

12. A single layer papermakers fabric as claimed in claim 10 wherein the weft cross-sectional area exceeds the warp cross-sectional area by a range between 10% and 15%.

13. A single layer papermakers fabric as claimed in claim 1 wherein the fabric has an air permeability in a range of 450 to 1,200 cubic feet per minute.

14. A single layer papermakers fabric as claimed in claim 1 wherein the fabric has a mesh in a range of 20 to 70 yarns per inch.

15. A single layer papermakers fabric as claimed in claim 1 which is a through air dryer fabric.

16. A single layer papermakers fabric as claimed in claim 1 which is a forming fabric.

* * * * *